US007694933B2

(12) United States Patent
Washer et al.

(10) Patent No.: US 7,694,933 B2
(45) Date of Patent: Apr. 13, 2010

(54) CARD PRODUCT DISPLAY SYSTEM

(75) Inventors: Wayne Washer, Alpharetta, GA (US); David Bernstein, Marietta, GA (US)

(73) Assignee: e2Interactive, Inc., Atlanta, GA (US)

( * ) Notice: Subject to any disclaimer, the term of this patent is extended or adjusted under 35 U.S.C. 154(b) by 172 days.

(21) Appl. No.: 11/510,188

(22) Filed: Aug. 25, 2006

(65) Prior Publication Data

US 2008/0048092 A1 Feb. 28, 2008

(51) Int. Cl.
*F16M 11/00* (2006.01)

(52) U.S. Cl. ..... 248/690; 248/682

(58) Field of Classification Search ..... 248/690, 248/682, 692, 227.1, 304, 339, 301, 302, 248/317; 211/59.1, 87.01, 57.1, 187; 40/642.01, 40/642.02

See application file for complete search history.

(56) References Cited

U.S. PATENT DOCUMENTS 2,312,985 A * 3/1943 Bales ..... 248/220.43
2,976,990 A * 3/1961 Nevai ..... 206/300
4,516,681 A * 5/1985 Jahel ..... 211/59.1
4,671,417 A 6/1987 O'Brien
4,688,683 A * 8/1987 Thalenfeld et al. ..... 211/57.1
5,080,238 A * 1/1992 Hochman ..... 211/59.1
5,104,083 A * 4/1992 Shannon ..... 248/339
5,109,993 A 5/1992 Hutchinson
5,154,304 A * 10/1992 McAuley ..... 211/59.1
5,375,725 A 12/1994 Rosenthal
5,431,207 A 7/1995 Siegel
5,503,277 A * 4/1996 O'Brien ..... 211/106.01
5,611,438 A 3/1997 Dye
5,647,566 A * 7/1997 Kump ..... 248/220.21
6,029,827 A 2/2000 Valiulis
6,234,436 B1 5/2001 Kump
6,612,448 B2 * 9/2003 Plutsky ..... 211/43
6,789,771 B1 * 9/2004 Shick et al. ..... 248/121
7,063,255 B2 6/2006 Algiene
7,219,806 B1 * 5/2007 Morrow ..... 211/59.1
7,278,570 B2 10/2007 McGee et al.
2002/0113183 A1 * 8/2002 Mattesky ..... 248/220.41
2004/0149870 A1 * 8/2004 Brannen et al. ..... 248/213.2
2004/0195192 A1 * 10/2004 Belokin et al. ..... 211/59.1
2005/0029205 A1 * 2/2005 Mansfield et al. ..... 211/7
2005/0121573 A1 * 6/2005 Ahlund et al. ..... 248/220.21
2006/0261016 A1 * 11/2006 Magid ..... 211/57.1

* cited by examiner

*Primary Examiner*—A. Joseph Wujciak, III
(74) *Attorney, Agent, or Firm*—Hunton & Williams LLP

(57) ABSTRACT

A display unit for hanging products comprising a substantially planar base having a front side, a back side, a left edge, and a right edge. The display unit may further comprise an elongated hook extending forwardly from the front side of the base, the hook having a proximal end joined to the base and a distal end. In addition, the display unit may comprise a securing mechanism attached to the back side of the base, the securing mechanism being adapted to selectively secure the display unit to a vertical surface.

12 Claims, 7 Drawing Sheets

CARD PRODUCT DISPLAY SYSTEM

BACKGROUND OF THE INVENTION

The present invention generally relates to the field of retail display racks for hanging products. Specifically, the present invention is directed to a modular display system for hanging card products at a retail point of sale.

Retail stores are often looking for ways to more effectively display and sell their products, particularly products located at the point-of-sale which typically have significantly higher sales than products displayed elsewhere in the store. These point-of-sale displays should be attractive, cost-effective, and easy to use for both the retailers stocking the products and the customers purchasing the products. The display systems should also be flexible and modular in order to account for the varying conditions existing at different retail locations.

There are a number of common product display systems. One common approach involves mounting a hanger or hook on a pegboard using pegs that are inserted into holes in the pegboard. Another approach known in the art involves a slat-wall system, in which a hanger is secured to a wall or panel by inserting a channel engaging structure attached to the hanger into a channel located on the wall.

Existing pegboard and slat-wall systems tend to suffer from being expensive, unattractive, and/or unstable. Typically, hangers are individually attached to the pegboard or slat-wall, and thus, are held stable only by the pegs or other attachment mechanisms located on the hanger. Such hangers frequently become dislodged accidentally by customer attempts to remove a product from the display for purchase. Such accidental dislodging may lead to embarrassment for or injury to the customer, a lost sale, and potentially substantial cost and effort to repair. Often, the hangers are made of metal to add strength, however, these hangers may be more expensive and less flexible than alternative materials available, such as plastic.

Generally, hangers made of plastic consist simply of a cylindrical hook that extends outward and upward from the panel to which it is attached. Such an arrangement does not offer much in terms of functionality or style. For example, the product may rotate or turn on the hook and it may accordingly be difficult to ensure that the product maintains a proper display position. Additionally, typical product display systems do not have integrated enhancements beyond the hanger, such as an integrated holder for a product sign or advertisement, or integrated slots for hanging a placebo card holder that may contain product information and assist in maintaining proper product positioning.

Accordingly, a product display system that provides a more attractive, functional, and cost-effective solution, particularly for card products, is desirable.

SUMMARY OF THE INVENTION

Some embodiments of the present invention include a display unit for handling products. The display unit may comprise a substantially planar base having a front side, a back side, a left edge, and a right edge, wherein the left edge is adapted to be selectively attached to a right edge of a substantially identical display unit and wherein the right edge is adapted to be selectively attached to a left edge of a second substantially identical display unit. The display unit may also comprise an elongated hook extending forwardly from the front side of the base, the hook having a proximal end joined to the base and a distal end. In addition, the display unit may include a securing mechanism attached to the back side of the base, the securing mechanism being adapted to selectively secure the display unit to a vertical surface.

In some embodiments of the invention, a distal portion of the hook forms an obtuse angle with a proximal portion of the hook. The hook may also have an edge about its perimeter, the edge having a substantially circular cross section. In addition, the hook may extend from the front side at an angle less than ninety degrees. In some embodiments of the invention, the hook may also have a telescoping mechanism adapted to allow a user to adjust the hook to a plurality of lengths.

These and other aspects will become apparent from the following description of exemplary embodiments of the invention taken in conjunction with the following drawings, although variations and modifications may be effected without departing from the spirit and scope of the novel concepts of the disclosure. It is to be understood that both the foregoing general description and the following detailed description are exemplary and explanatory only, and are not restrictive of the invention as claimed. The accompanying drawings constitute a part of the specification, illustrate certain embodiments of the invention and, together with the detailed description, serve to explain the principles of the invention.

DESCRIPTION OF THE DRAWINGS

In order to assist in the understanding of the invention, reference will now be made to the appended drawings, in which like reference characters refer to like elements. The drawings are exemplary only, and should not be construed as limiting the invention.

DETAILED DESCRIPTION OF THE INVENTION

Figure 1:
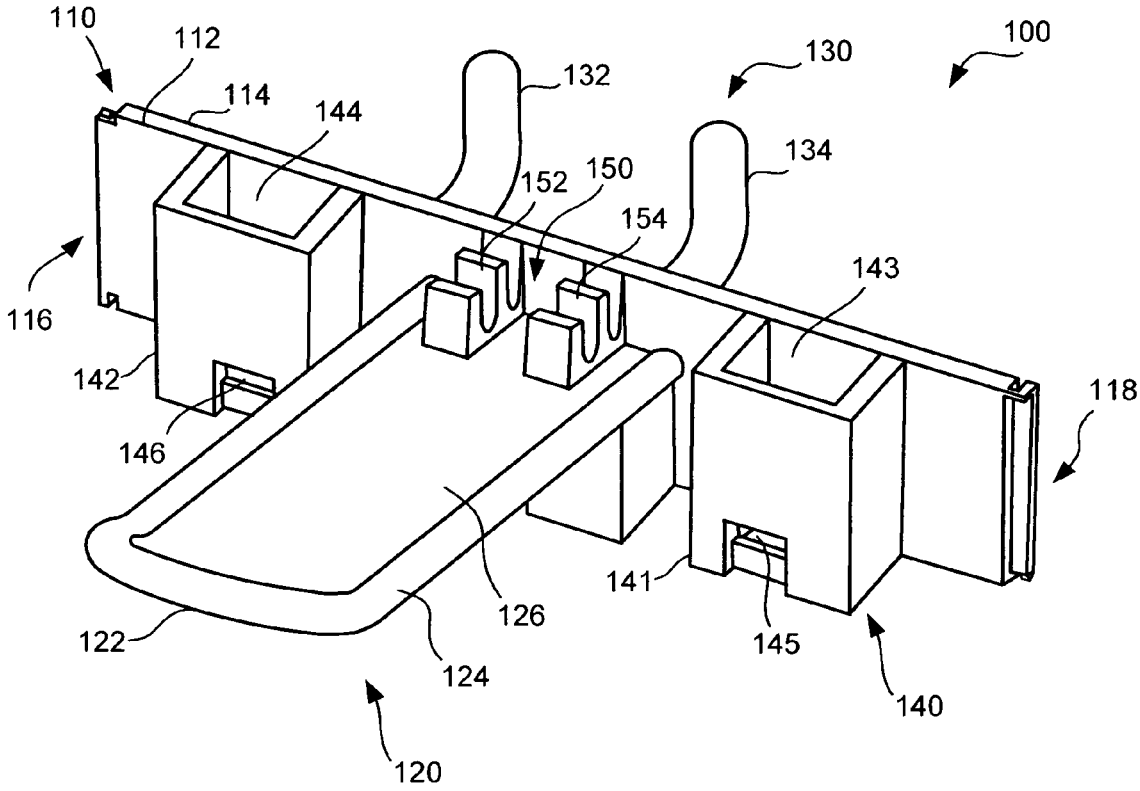
FIG. 1 is a perspective view of a display unit in accordance with some embodiments of the invention.
Figure 2:
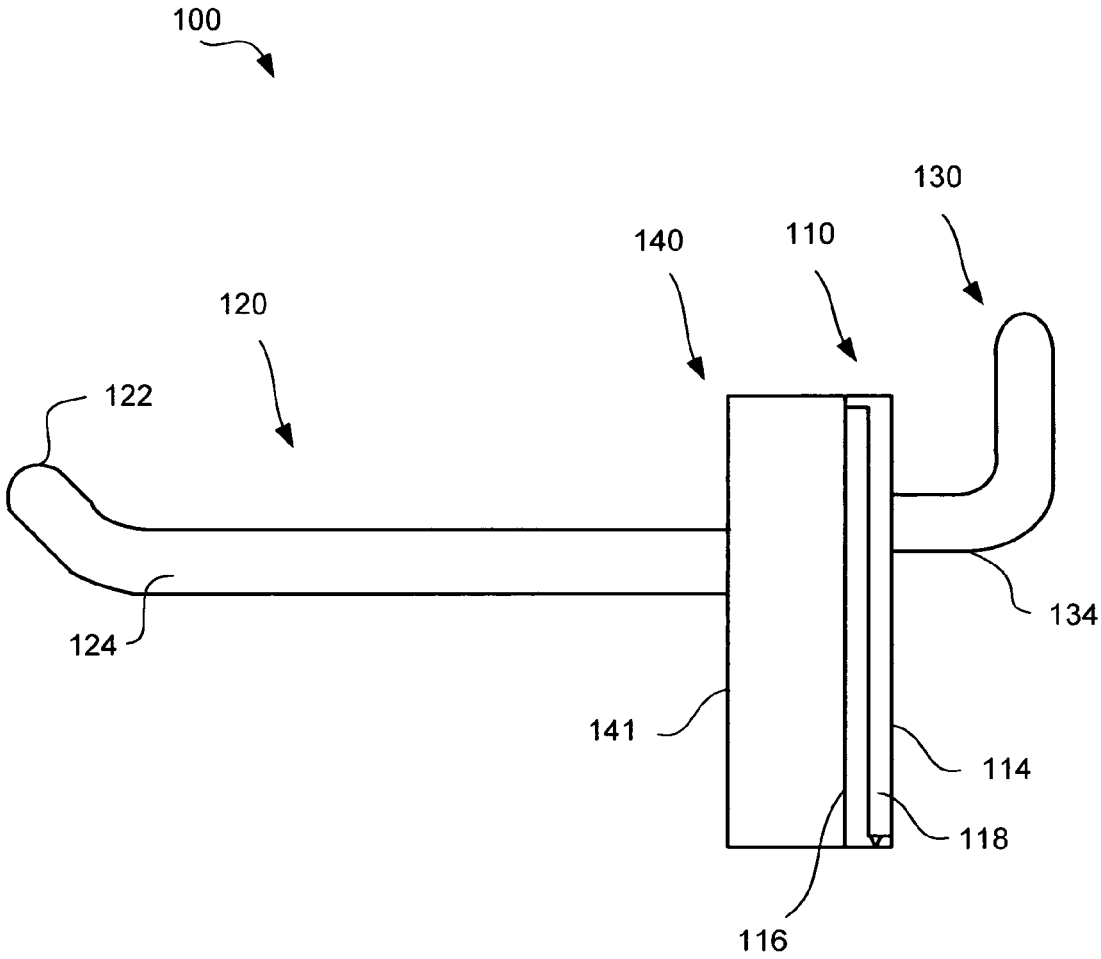
FIG. 2 is a side view of a display unit in accordance with some embodiments of the invention.
Figure 3:
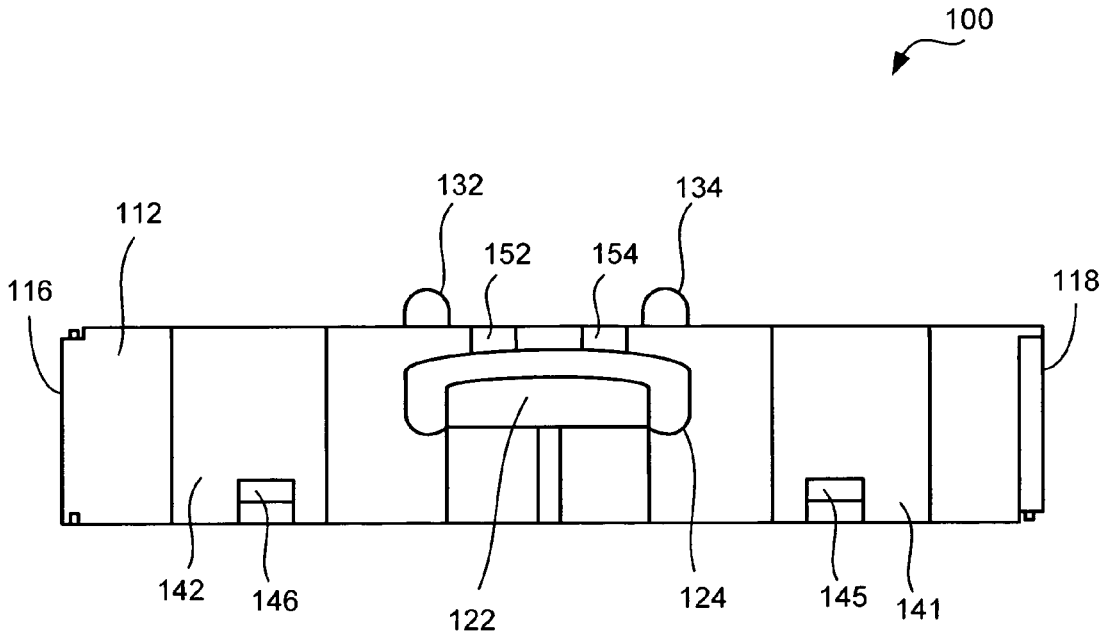
FIG. 3 is a front view of a display unit in accordance with some embodiments of the invention.

FIGS. 1, 2, and 3 illustrate a perspective view, side view, and front view, respectively, of a display unit 100 in accordance with some embodiments of the invention. The display units 100 of the present invention may be used individually, or may be used in conjunction with other display units 100.

A display unit 100 may comprise a base 110 with a hook 120 and a securing mechanism 130 attached to the base 110. The hook 120 may act as a support for hanging products, such as card products, and the securing mechanism 130 may act to secure the base 110 to a vertical surface, such as a peg board display wall.

The base 110 may be a substantially planar member having a front side 112 and a back side 114. The hook 120 may be attached to the front side 112 of the base 110. The securing mechanism 130 may be attached to the back side 114 of the base 110. The back side 114 may be mostly flat to allow the display unit 100 to mount flush against a vertical surface. The base 110 also includes a left edge 116 and a right edge 118. As discussed further below, the left edge 116 may optionally be adapted to attach to the right edge 118 of an identical display unit 100, and the right edge 118 may optionally be adapted to attach to the left edge 116 of another identical display unit 100, thus allowing for multiple display units to be connected together to form a display system or rack.

The hook 120 may be an elongated, substantially horizontal support member adapted to hold hanging products, e.g., card products. The hook 120 may have a proximal end joined to the base 110 and a free distal end (or tip) 122 over which cards may be passed and hung on the hook 120. The hook 120 may protrude from the base 110 at a slight inclination from horizontal so that the hanging products tend to slide toward the base 110. The hook 120 may also comprise an edge 124 that surrounds a tray 126. The edge 124 may have a circular cross-section, with a diameter larger than the thickness of the tray 126, thus creating a rim around the tray 126. The tray 126 may be solid or partially open, such as a mesh pattern. Alternatively, the tray 126 may be completely open, such that the hook 120 primarily comprises the edge 124. Indicia, such as a trademark, may be placed on the solid portions of the tray 126, such as by printing, engraving, embossing, adhesive labels, etc. In some embodiments of the invention, the tip 122 of the hook 120 may bend upward, as shown in FIGS. 1-3, in order to prevent product from inadvertently falling off of the hook 120.

The hook 120 may be of a fixed length. In some embodiments of the invention, the hook 120 may also include a mechanism (not shown) for adjusting the distance the hook 120 protrudes from the base 110. For example, the hook 120 may comprise horizontally telescoping or sliding parts. With such a hook, the user may be able to size the hook at the point-of-sale in order to accommodate the particular size or quantity of the products being displayed. Alternatively, a longer hook (not shown) may be slipped over the existing hook 130.

The securing mechanism 130 may comprise any form known in the art for securing the base 110 to a vertical surface. The securing mechanism 130 may allow for either selective attachment, e.g., pegs for inserting into a peg board, or permanent attachment, e.g., an adhesive, of the base 110 to a surface. FIGS. 1-3 illustrate the use of two curved pegs, 132, 134, which protrude horizontally from the back side 114 of the base 110 and bend upwards. The curved pegs 132, 134 may be adapted for insertion into peg holes on a pegboard (not shown) or into any two properly spaced and sized apertures on any relatively flat and substantially vertical surface. For maximum stability, the curved pegs 132, 134 may be positioned symmetrically about a vertical axis located at the center of the base plate. Other forms of securing the base to a surface include, but are not limited to, glue, adhesive, Velcro®, snaps, clips, mechanical affixation (e.g., threads), etc.

The display unit 100 may also comprise one or more channels 140 located on the front side 112 of the base 110. FIGS. 1 and 3 illustrate two channels 141, 142 located symmetrically about a vertical axis at the center of the base. The channels 141, 142 may comprise a back face, made up of a portion of the front side 112 of the base 110, and a front face, which is connected to the back face by two or more side faces. Each channel 141, 142 may comprise an open cavity 143, 144 running vertically through the center of the channels. The hollow channel 141, 142 may add stability and strength to the display unit 100 without adding much in terms of cost or weight. Additionally, the front face of each channel 141, 142 may comprise a slot 145, 146, adapted to accept a vertically hanging member 420, as discussed further below.

The display unit 100 may comprise a holding mechanism 150 adapted to receive and secure a vertical standing member 410, such as a display advertisement card, as discussed further below in reference to FIGS. 4-6. The holding mechanism 150 may be attached to the hook 120 and/or the base 110. FIG. 1 illustrates the holding mechanism 150 in the form of two C-shaped snaps 152, 154 attached to the base 110 and the tray 126 near the distal end of the hook 120. The C-shaped snaps 152, 154 may project upwards from the tray 126, as shown in FIG. 1, or the snaps may project forwardly from the front side 112 of the base 110. As an alternative to C-shaped snaps, the holding mechanism may comprise other forms known in the art, such as a clip, slot, etc., for holding a display card or similar object substantially vertical.

Figure 4:
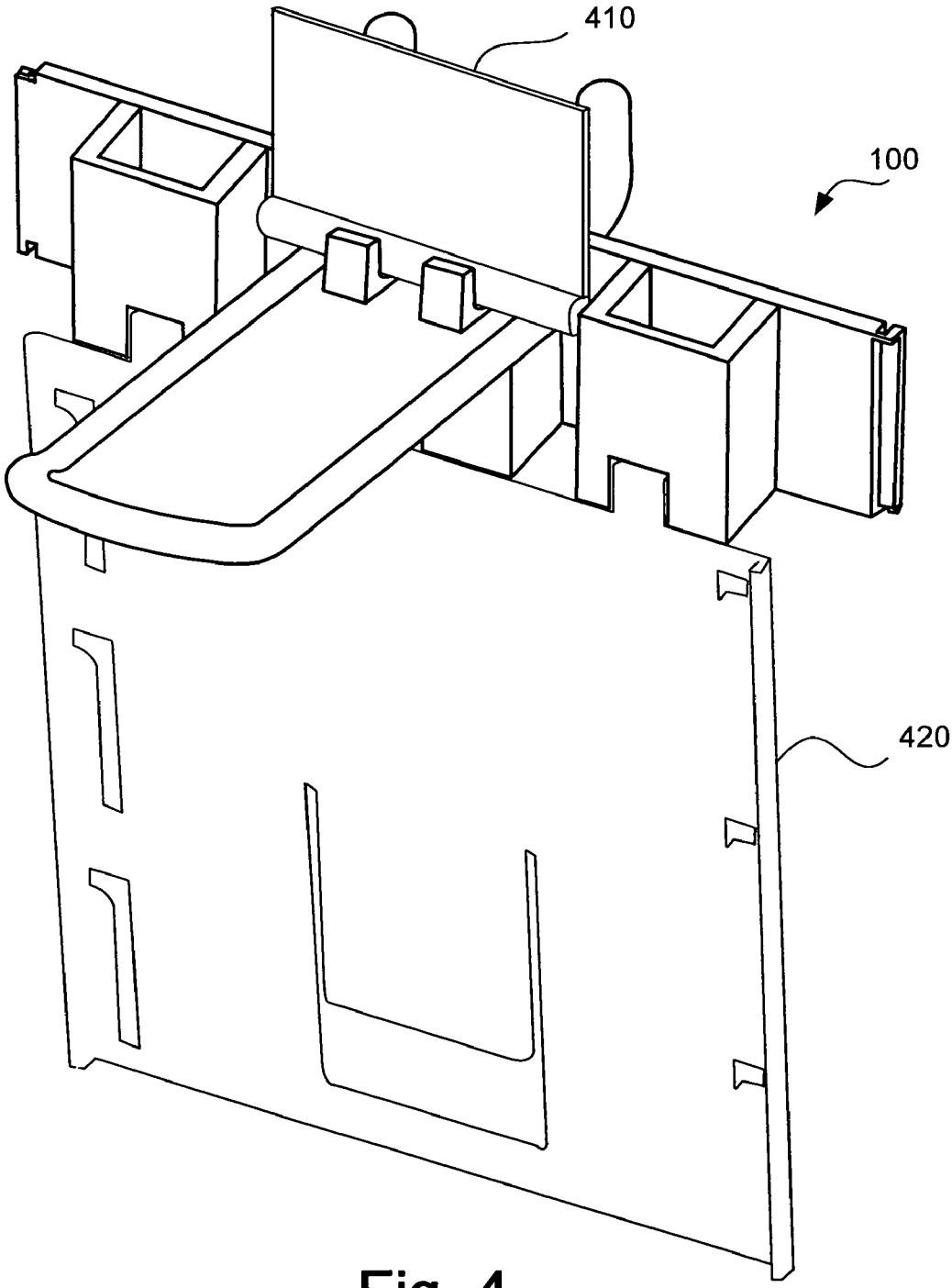
FIG. 4 is a perspective view of a display unit with an installed vertical standing member and an installed vertical hanging member in accordance with some embodiments of the invention.

FIG. 4 illustrates a display unit 100 with an installed vertical standing member 410 and an installed vertical hanging member 420 in accordance with some embodiments of the invention. The vertical standing member 410 may be selectively attached or permanently attached. The vertical standing member 410 may also comprise indicia (not shown), such as a product label or advertisement, a bar code, pricing information for the particular product or item displayed, etc.

The vertical hanging member 420 may be used to hold and display a placebo product. The vertical hanging member 420 may comprise various channels and/or other retaining means for holding such product, and may further comprise attachment means for attaching the vertical hanging member 420 to the display unit 100. The attachment means for attaching the vertical hanging member 420 to the display unit may allow the vertical hanging member 100 to be attached to, or removed from, the display unit 100 without the need for the display unit 100 to be removed from its installed location.

In use the vertical hanging member 420 with an placebo installed therein may serve at least two functions. The placebo may present the merchant or consumer with information regarding the product or item to be displayed on the display unit 100. First, a placebo installed in the vertical hanging member 420 may display information indicating which particular product or item is to be displayed on a particular display unit 100. Second, should a particular product or item be sold out or no longer present on the display unit 100, a placebo installed in the vertical hanging member may present the consumer with information sufficient to request the particular product or item despite its unavailability from the display unit 100. Placebos may be information cards, unactivated or deactivated product cards, and/or any other means for displaying information to the merchant or consumer about a particular product or item.

As noted above, the vertical hanging member 420 may be removed from the display unit 100 without uninstalling the display unit 100 from a vertical surface. In this manner, various products may be displayed on the display unit 100, and the various vertical hanging members 420 and/or placebos may be used.

Figure 5:
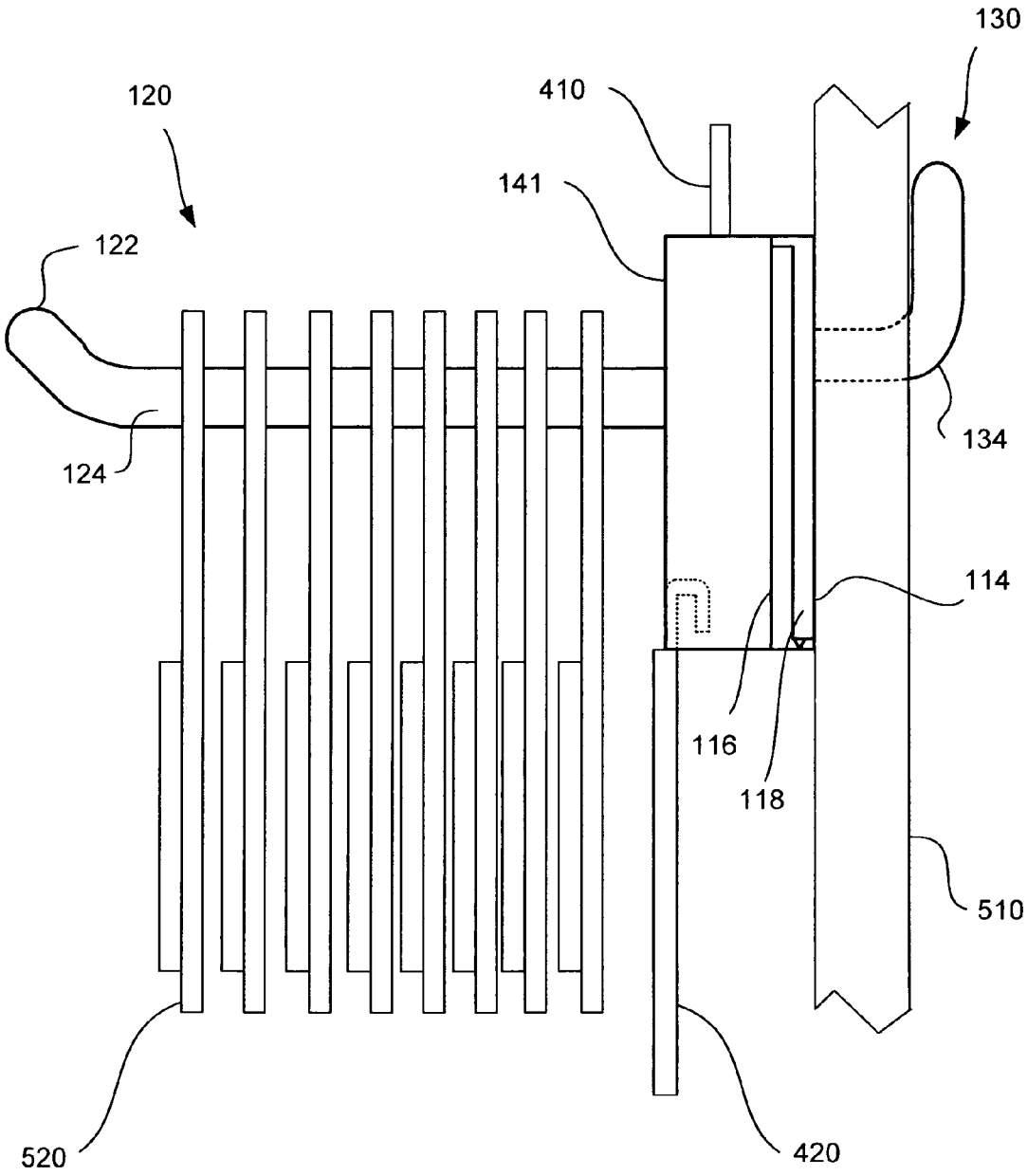
FIG. 5 is a side view of an installed, pre-stocked display unit with an installed vertical standing member and an installed vertical hanging member in accordance with some embodiments of the invention.

FIG. 5 illustrates an installed, pre-stocked display unit 100 with an installed vertical standing member 410 and an installed vertical hanging member 420 in accordance with some embodiments of the invention. In FIG. 5, the display unit comprises a securing mechanism 130 using pegs 132, 134 that can be inserted into holes in a vertical wall 510 such that the display unit 100 may be securely attached to the wall 510. The display unit 100 may be configured to allow for hanging products 520, such as packaged card products, on the hook 120. As shown, the hook 120 may comprise an upturned tip 122 to prevent the products 520 from being inadvertently removed from the hook 120. The vertical standing member 410 may be configured such that a consumer can view the standing member 410 when viewing a stocked display unit. The vertical hanging member 420 may be configured to hang discretely behind the products 520 (as shown), or the vertical hanging member 420 may be configured to be larger than the products such that a consumer can view a portion of the vertical hanging member 420 when viewing the products 520.

Figure 6:
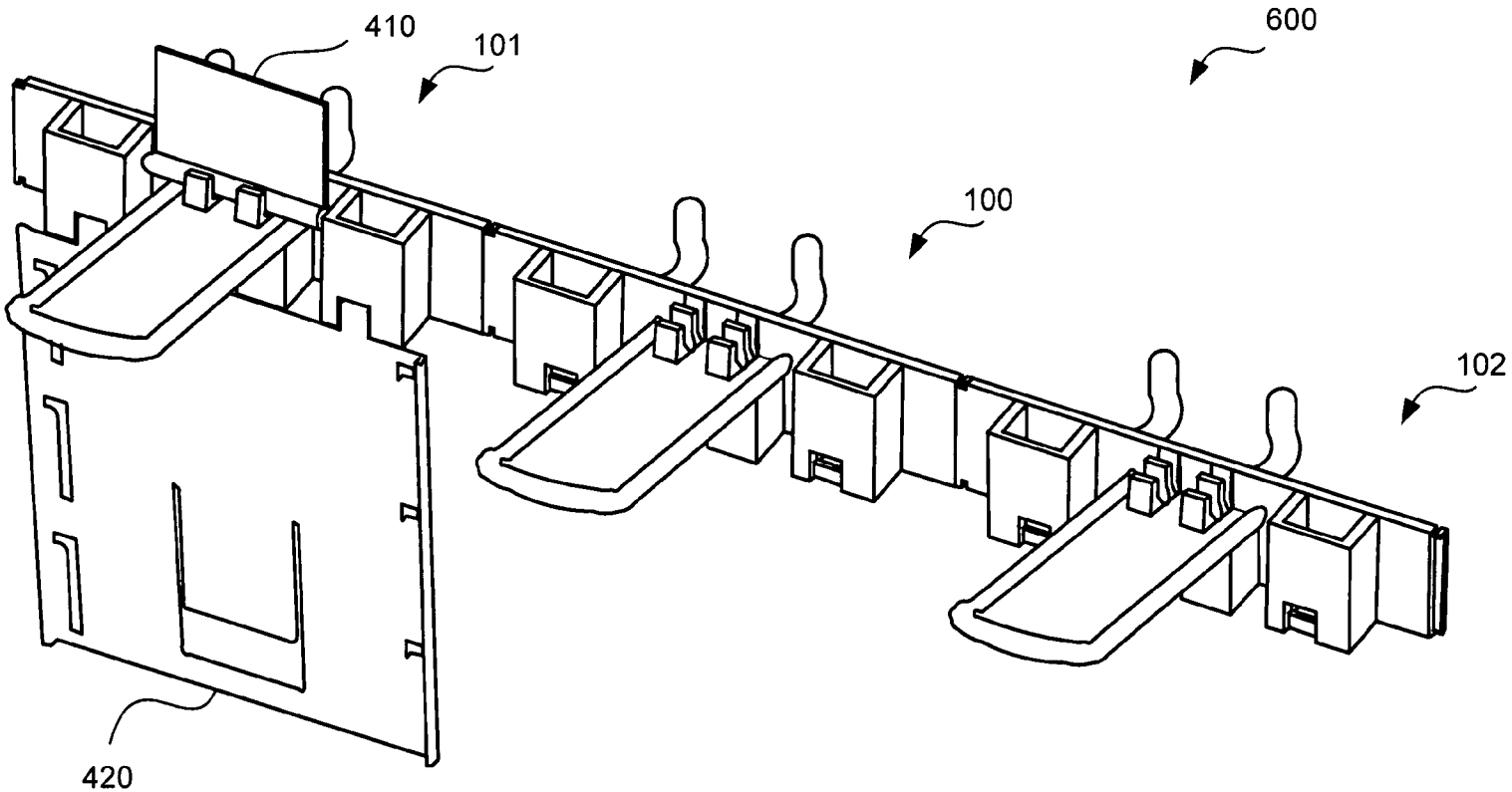
FIG. 6 is a perspective view of a display system including multiple, connected display units in accordance with some embodiments of the invention.

With reference to FIGS. 6 and 7, in some embodiments of the present invention the edges of the display unit 101 may be modified so that multiple display units may be connected together. FIG. 6 illustrates a display strip 600 comprising multiple, connected display units 100, 101, 102 in accordance with some embodiments of the invention. The right edge of display unit 101 may be connected to the left edge of display unit 100, and the left edge of display unit 102 may be connected to the right edge of display unit 100, forming a three-unit display strip. A display strip may comprise any number of display units, depending on the needs of the user and the space available. In addition, a display strip may comprise identical display units, as shown in FIG. 6, or a display strip may comprise compatible display units that are not identical. Compatible display units are units configured to attach to each other, but may not necessarily be identical. For example, two display units may be compatible, but one may have a longer hook than the other. The connection between the edges of two display units in a display system may be formed by snap, hook, Velcro®, lock, adhesive, mechanical attachment, or other means as known in the art.

Figure 7B:
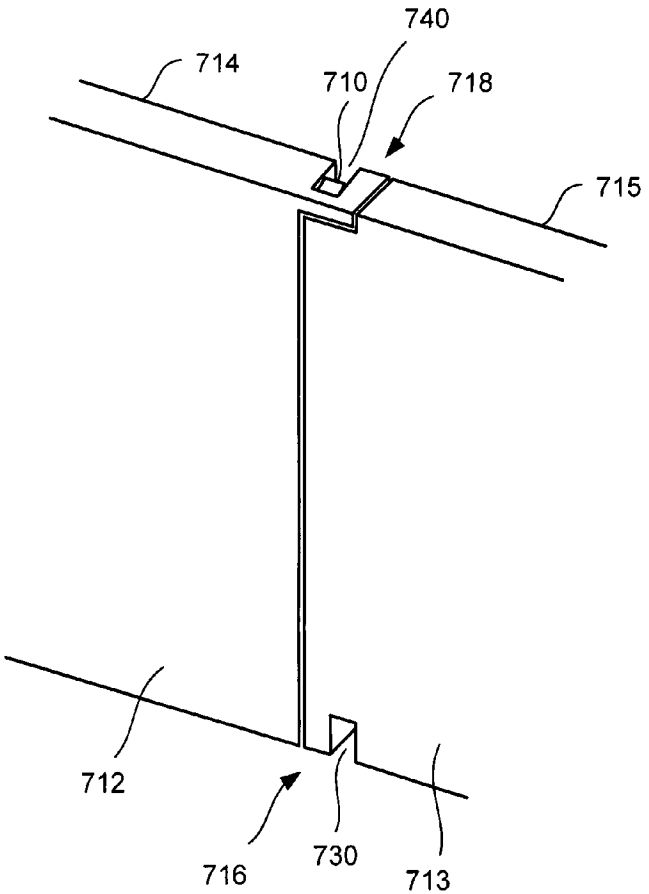
FIGS. 7A and 7B are enlarged views of a left edge of one display unit and the right edge of another display unit, unattached and attached, respectively, in accordance with some embodiments of the invention.
Figure 7A:
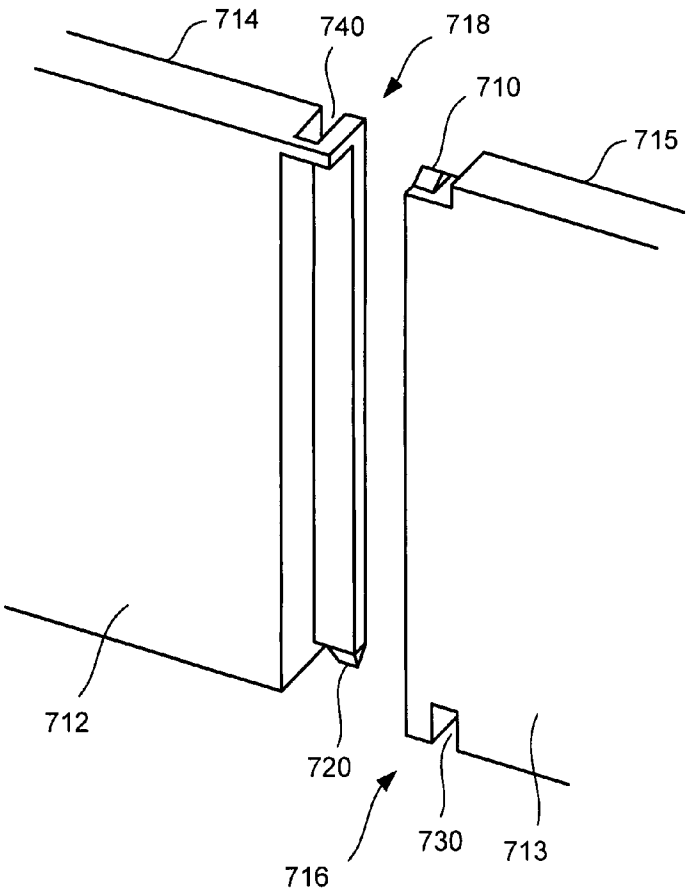

FIGS. 7A and 7B are enlarged views of a left edge of one display unit and the right edge of another display unit, unattached and attached, respectively, in accordance with some embodiments of the invention.

With reference to FIGS. 7A and 7B, the left edge 716 of one display unit may comprise a raised portion 710 at the top of the edge and an opening 730 at the bottom of the edge. The right edge 718 of a second display unit may comprise an opening 740 at the top of the edge and a raised portion 720 at the bottom edge of the edge. The edges 716, 718 may be configured to allow the raised portions 710, 720 of one edge to snap into the openings 730, 740 of the opposing edge, thereby allowing for a secure attachment, as shown in FIG. 7B. FIGS. 7A and 7B are merely an example of one kind of attachment. Other attachments that are known in the art, such as snaps, clips, adhesive, sliding mechanisms, etc., are contemplated within the present invention.

It will be apparent to those skilled in the art that various modifications and variations can be made in the method, manufacture, configuration, and/or use of the present invention without departing from the scope or spirit of the invention.

What is claimed is:

1. A display unit for hanging products comprising:

a substantially planar base having a front side, a back side, a left edge, and a right edge, the left edge of the substantially planar base being adapted to be selectively attached to a right edge of a substantially identical display unit, and the right edge of the substantially planar base being adapted to be selectively attached to a left edge of a second substantially identical display unit;

an elongated hook extending forwardly from the front side of the base, the hook having a proximal end joined to the base and a distal end;

a securing mechanism attached to the back side of the base, the securing mechanism being adapted to selectively secure the display unit to a vertical surface;

at least two channels on the front side of the base, wherein the at least one channel comprises a front face, a back face, and at least two side faces, the back face including a portion of the front side of the base, the front face being substantially parallel to the back face, and wherein the at least one channel has an open cavity parallel to the front side of the base, the at least two channels being located substantially symmetrically about a vertical axis at the center of the base, and the front face of each of the two channels includes a slot configured to receive a vertically hanging member; and wherein the left edge of the substantially planar base comprises a raised portion at the top of the left edge and an opening at the bottom of the left edge, and wherein the right edge of the substantially planar base comprises an opening at the top of the right edge and a raised portion at the bottom of the right edge.

2. The display unit of claim 1, wherein the left edge of the planar base and the right edge of a substantially identical display unit are configured to be selectively attached by an adhesive.

3. The display unit of claim 1, wherein a distal portion of the hook forms an obtuse angle with a proximal portion of the hook.

4. The display unit of claim 1, wherein the hook has an edge about its perimeter, the edge having a substantially circular cross section.

5. The display unit of claim 1, wherein the hook extends from the front side at an angle less than ninety degrees.

6. The display unit of claim 1, wherein the securing mechanism comprises at least two pegs extending rearwardly from the back side of the base, at least a portion of each peg being curved.

7. The display unit of claim 6, wherein the at least two pegs comprise exactly two pegs, the exactly two pegs being positioned substantially symmetrically about a vertical axis at the center of the base.

8. The display unit of claim 1, further comprising:

a holding mechanism attached to the front side of the base near the distal end of the hook, the holding mechanism being adapted to selectively secure a vertically standing member.

9. The display unit of claim 8, wherein the holding mechanism comprises two substantially C-shaped snaps, the two substantially C-shaped snaps being configured to receive a horizontal, cylindrical portion of a vertically standing member.

10. The display unit of claim 1, wherein the display unit is an integral, one-piece unit comprising molded plastic.

11. A display unit for hanging products comprising:

a substantially planar base having a front side, a back side, a left edge, and a right edge, wherein the left edge is adapted to be selectively attached to a right edge of a substantially identical display unit and wherein the right edge is adapted to be selectively attached to a left edge of a second substantially identical display unit, wherein the left edge of the substantially planar base comprises a raised portion at the top of the left edge and an opening at the bottom of the left edge, and wherein the right edge of the substantially planar base comprises an opening at the top of the right edge and a raised portion at the bottom of the right edge, and wherein the raised portion at the top of the left edge of the substantially planar base may be inserted into the opening at the top of the right edge of the substantially identical display unit, and wherein the raised portion at the bottom of the right edge of the substantially planar base may be inserted into the opening at the bottom of the left edge of the second substantially identical display unit so that the substantially planar base, the substantially identical display unit, and the second substantially identical display unit are attached;

an elongated hook extending forwardly from the front side of the base, the hook having a proximal end and a distal end;

a securing mechanism attached to the back side of the base, the securing mechanism being adapted to selectively secure the display unit to a vertical surface; and at least one channel on the front side of the base, wherein the at least one channel comprises a front face, a back face, and at least two side faces, the back face including a portion of the front side of the base, the front face being substantially parallel to the back face, and wherein the at least one channel has an open cavity parallel to the front side of the base, wherein the at least one channel comprises two channels, the two channels being located substantially symmetrically about a vertical axis at the center of the base, and the front face of each of the two channels includes a slot configured to receive a vertically hanging member; and at least one substantially C-shaped snap attached to the hook near the distal end of the hook, the at least one substantially C-shaped snap being configured to receive a horizontal, cylindrical portion of a vertically standing member.

12. The display unit of claim 11, wherein the display unit is an integral, one-piece unit comprising molded plastic.

* * * * *